US010083707B1

(12) United States Patent
Ou

(10) Patent No.: US 10,083,707 B1
(45) Date of Patent: Sep. 25, 2018

(54) VOICE APPARATUS AND DUAL-MICROPHONE VOICE SYSTEM WITH NOISE CANCELLATION

(71) Applicant: C-MEDIA ELECTRONICS INC., Taipei (TW)

(72) Inventor: Kuen-Ying Ou, Taichung (TW)

(73) Assignee: C-MEDIA ELECTRONICS INC., Taipei (TW)

( * ) Notice: Subject to any disclaimer, the term of this patent is extended or adjusted under 35 U.S.C. 154(b) by 0 days.

(21) Appl. No.: 15/788,979

(22) Filed: Oct. 20, 2017

(30) Foreign Application Priority Data

Jun. 28, 2017 (TW) ..... 106121582 A

(51) Int. Cl.
*G10K 11/175* (2006.01)
*G10L 21/02* (2013.01)
*G10L 25/84* (2013.01)

(52) U.S. Cl.
CPC ..... *G10L 21/02* (2013.01); *G10L 25/84* (2013.01)

(58) Field of Classification Search
USPC ... 381/92, 71.11, 71.1, 94.2, 94.3, 94.1, 122
See application file for complete search history.

(56) References Cited

U.S. PATENT DOCUMENTS 9,215,527 B1 * 12/2015 Saric ..... H04R 3/005
2005/0105716 A1 * 5/2005 Das ..... H04Q 1/46 379/376.02
2014/0072142 A1 * 3/2014 Nakadai ..... H04R 1/32 381/92

* cited by examiner

*Primary Examiner* — Yosef K Laekemariam
(74) *Attorney, Agent, or Firm* — Li & Cai Intellectual Property (USA) Office

(57) ABSTRACT

The present disclosure illustrates a voice apparatus and a dual-microphone voice system with noise cancellation. A voice detector and a noise detector simultaneously receive a first voice source and a second voice source to acquire a first main signal with a voice band and a second main signal with a burst noise band respectively. A voice filter filters a voice signal of the first main signal to remain a burst noise signal with a little voice signal (i.e., a remained noise). A noise filter filters a burst noise signal of the second main signal to remain a voice signal with a little burst noise signal (i.e., a remained voice). A post-filter generates a noise reduction gain according to the remained voice and the remained noise and adjusts the remained voice according to the noise reduction gain to generate the voice signal.

11 Claims, 5 Drawing Sheets

VOICE APPARATUS AND DUAL-MICROPHONE VOICE SYSTEM WITH NOISE CANCELLATION

BACKGROUND

1. Technical Field

The present disclosure relates to a voice apparatus and a dual-microphone voice system, in particular, to a voice apparatus and a dual-microphone voice system which are used for cancelling a burst noise signal indicating a keyboard sound and a button sound and are used for remaining a voice signal indicating a human voice.

2. Description of Related Art

A conventional voice apparatus uses a microphone to receive external voice (e.g., human voice) and ambient noise (e.g., environment noise, button sound, keyboard sound, or etc.), and cancels the ambient noise by an algorithm, thereby sending out a clear voice. More specifically, when the microphone receives the external voice and the ambient noise to generate a mixed sound to the voice apparatus, the conventional voice apparatus uses voice activity detection (VAD) and an adaptive filter to cancel the ambient noise and then generate the clear voice by a post-filter.

However, the conventional voice apparatus uses one sound signal, i.e., the mixed sound (including the external voice and the ambient noise) to cancel the ambient noise. It is easy to cause an unstable noise reduction effect. Therefore, if the noise reduction effect can be improved, the voice apparatus will generate clearer voice.

SUMMARY

Accordingly, exemplary embodiments of the present disclosure provide a voice apparatus and a dual-microphone voice system with noise cancellation, which receive an external voice and an ambient noise (e.g., a keyboard sound) by a dual-microphone to generate two mixed sounds respectively. Then the voice apparatus and the dual-microphone voice system further determine and process the two mixed sounds to cancel the ambient noise stably and maintain the clear external voice simultaneously.

An exemplary embodiment of the present disclosure provides a voice apparatus with noise cancellation. The voice apparatus is used for cancelling a burst noise signal and remaining a voice signal. The voice apparatus includes a voice detector, a noise detector, a voice filter, a noise filter, and a post-filter. The voice detector is configured for receiving a first signal generated from a first microphone and a second signal generated from a second microphone and is configured for taking a voice band of the first signal as a first main signal. When the voice detector determines that the first main signal has the voice signal, the voice detector generates a first result signal. The first microphone is close to a voice source and the second microphone is close to a noise source. The noise detector is configured for receiving the first signal and the second signal and is configured for taking a burst noise band of the second signal as a second main signal. When the noise detector determines that the second main signal has the burst noise signal, the noise detector generates a second result signal. The voice filter is coupled to the voice detector and calculates a remained noise according to the first result signal, the first main signal, and the first signal. The noise filter is coupled to the noise detector and calculates a remained voice according to the second result signal, the second main signal, and the second signal. The post-filter is coupled to the voice filter and the noise filter. The post-filter generates a noise reduction gain according to the remained voice and the remained noise and generates the voice signal according to the noise reduction gain and the remained voice. When the post-filter determines that the first main signal has the voice signal, the post-filter maintains or increases the noise reduction gain. When the post-filter determines that the first main signal does not have the voice signal, the post-filter decreases the noise reduction gain.

An exemplary embodiment of the present disclosure provides a dual-microphone voice system with noise cancellation. The dual-microphone voice system is used for cancelling a burst noise signal indicating a keyboard sound and a button sound and is used for remaining a voice signal indicating a human voice. The dual-microphone voice system includes a first microphone, a second microphone, a voice detector, a noise detector, a voice filter, a noise filter, and a post-filter. The first microphone and a second microphone are configured for receiving the voice signal generated from a voice source and the burst noise signal generated from a noise source to respectively generate a first signal and a second signal. The voice detector is coupled to the first microphone and the second microphone. The voice detector receives the first signal and the second signal and takes a voice band of the first signal as a first main signal. When the voice detector determines that the first main signal has the voice signal, the voice detector generates a first result signal. The noise detector is coupled to the first microphone and the second microphone. The noise detector receives the first signal and the second signal and takes a burst noise band of the second signal as a second main signal. When the noise detector determines that the second main signal has the burst noise signal, the noise detector generates a second result signal. The voice filter is coupled to the voice detector and calculates a remained noise according to the first result signal, the first main signal, and the first signal. The noise filter is coupled to the noise detector and calculates a remained voice according to the second result signal, the second main signal, and the second signal. The post-filter is coupled to the voice filter and the noise filter. The post-filter generates a noise reduction gain according to the remained voice and the remained noise and generates the voice signal according to the noise reduction gain and the remained voice. When the post-filter determines that the first main signal has the voice signal, the post-filter maintains or increases the noise reduction gain. When the post-filter determines that the first main signal does not have the voice signal, the post-filter decreases the noise reduction gain.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
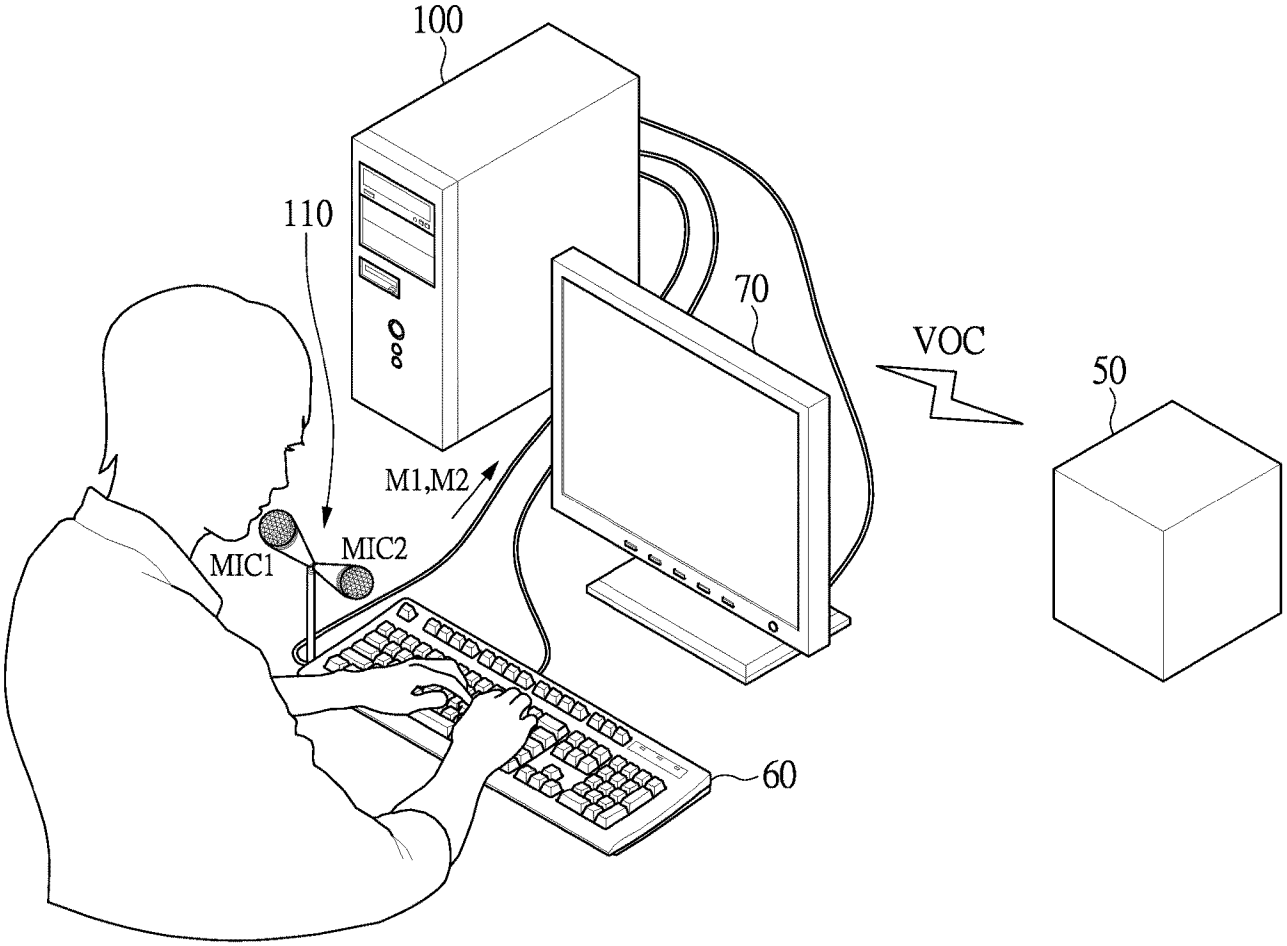
FIG. 1 shows a diagram of a user operating a dual-microphone voice system according to an embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

The present disclosure provides a voice apparatus and a dual-microphone voice system with noise cancellation. A voice detector and a noise detector simultaneously receive a first signal (including an external voice (e.g., a human voice) and an ambient noise (e.g., a keyboard sound, a button sound, or etc.)) and a second signal (including the external voice (e.g., the human voice) and the ambient noise (e.g., the keyboard sound, the button sound, or etc.)) to acquire a first main signal with a voice band and a second main signal with a burst noise band respectively. A voice filter filters the external voice to remain a remained noise (having some voices) according to a first result signal, a first main signal, and the first signal. A noise filter filters the ambient noise to remain a remained voice (having some noises) according to the second result signal, the second main signal, and the second signal. A post-filter generates a noise reduction gain according to the remained noise and the remained voice. Then the post-filter adjusts the remained voice according to the noise reduction gain to generate a clear voice signal. Accordingly, the voice apparatus and the dual-microphone voice system determine and process the first signal and the second signal to cancel the ambient noise stably and maintain the clear external voice simultaneously. The voice apparatus and the dual-microphone voice system with noise cancellation provided in the exemplary embodiment of the present disclosure will be described in the following paragraphs.

Reference is first made to FIG. 1, which shows a diagram of a user operating a dual-microphone voice system according to an embodiment of the present disclosure. As shown in FIG. 1, the dual-microphone voice system includes a voice apparatus 100 and a dual-microphone 110. The dual-microphone 110 is coupled to the voice apparatus 100. The dual-microphone 110 includes a first microphone MIC1 and a second microphone MIC2. In the present disclosure, the voice apparatus 100 can be a host computer, a smart phone, or other electronic devices. The present disclosure is not limited thereto. The voice apparatus 100 is coupled to a keyboard 60 and a monitor 70 and connects to a remote electronic device 50 by a wireless network. There is a predefined distance between the first microphone MIC1 and the second microphone MIC2. User (the present disclosure indicates a voice source) is closer to the first microphone MIC1 and farther away from the second microphone MIC2. The keyboard 60 (the present disclosure indicates a noise source) is closer to the second microphone MIC2 and farther away from the first microphone MIC1.

When the user speaks and types (i.e., striking the keyboard 60), the first microphone MIC1 and the second microphone MIC2 receive the voice signal generated from the user (the present disclosure indicates the voice source) and the burst noise signal generated from the keyboard 60 (the present disclosure indicates the noise source). Then the first microphone MIC1 and the second microphone MIC2 respectively generate the first signal M1 and the second signal M2 to the voice apparatus 100. Due to the setting relationship among the user, the keyboard 60, the first microphone MIC1, and the second microphone MIC2, when the user speaks and types, the voice signal of the first signal M1 will be higher than the burst noise signal of the first signal M1 and the voice signal of the second signal M2 will be lower than the burst noise signal of the second signal M2. When the user types only, the voice signal of the first signal M1 will be lower than the burst noise signal of the first signal M1 and the voice signal of the second signal M2 will be lower than the burst noise signal of the second signal M2.

The voice apparatus 100 is used for cancelling the burst noise signal generated from the noise source and is used for remaining the voice signal VOC generated from the voice source. The voice apparatus 100 will display the content of the user's typing on the monitor 70 and transmits the content to the remote electronic device 50 for the remote user watching. The voice apparatus 100 will also transmit the content of the user's speaking (i.e., the voice signal VOC) to the remote electronic device 50 for the remote user listening.

Figure 2:
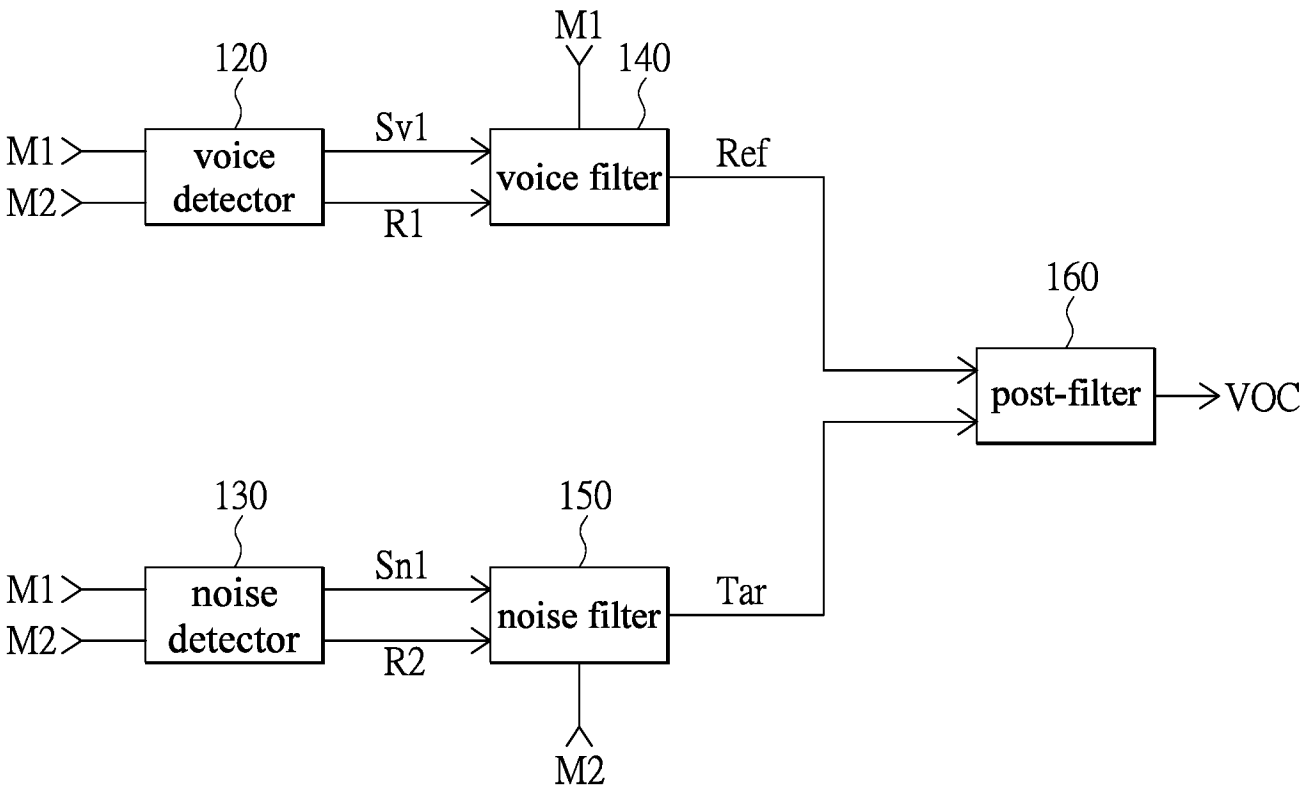
FIG. 2 shows a diagram of a voice apparatus according to an embodiment of the present disclosure.

More specifically, as shown in FIG. 2, the voice apparatus 100 has a voice detector 120, a noise detector 130, a voice filter 140, a noise filter 150, and a post-filter 160. The voice detector 120 receives the first signal M1 transmitted from the first microphone MIC1 and the second signal M2 transmitted from the second microphone MIC2. The voice detector 120 takes a voice band of the first signal M1 as a first main signal Sv1. When the voice detector 120 determines that the first main signal Sv1 has the voice signal VOC, the voice detector 120 generates a first result signal R1.

Figure 3A:
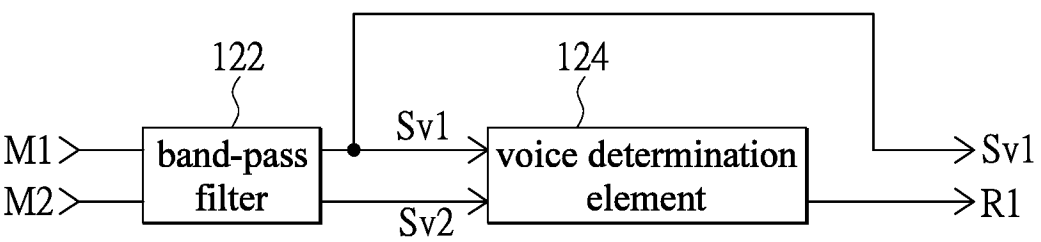
FIG. 3A shows a diagram of a voice detector according to an embodiment of the present disclosure.

Please refer to FIGS. 2 and 3A. In the present disclosure, the voice detector 120 includes a band-pass filter 122 and a voice determination element 124. The band-pass filter 122 takes the voice band of the first signal M1 as the first main signal Sv1 and takes the voice band of the second signal M2 as a first assistant signal Sv2. The voice band of the present disclosure is 300 Hz~2 k Hz (i.e., the human voice band). Therefore, the first main signal Sv1 is a 300 Hz~2 k Hz signal of the first signal M1 and the first assistant signal Sv2 is a 300 Hz~2 k Hz signal of the second signal M2. Certainly, the voice band can be set to be other suitable bands according to actual conditions. The present disclosure is not limited thereto.

The voice determination element 124 electrically connects to the band-pass filter 122 and compares the energy of the first main signal Sv1 with the energy of the second main signal Sv2. When the energy of the first main signal Sv1 is higher than the energy of the first assistant signal Sv2 to reach a predefined value, the voice determination element 124 determines that the first main signal Sv1 has the voice signal VOC and then generates the first result signal R1. For example, when the energy of the first main signal Sv1 is divided by the energy of the first assistant signal Sv2 and the calculation result is greater than 2, it indicates that the energy of the first main signal Sv1 is higher than the energy of the first assistant signal Sv2 to reach a predefined value. At this time, the voice determination element 124 generates the first result signal R1 with the high level. Conversely, when the energy of the first main signal Sv1 is lower than the energy of the first assistant signal Sv2 to a predefined, the voice determination element 124 determines that the first main signal Sv1 does not have the voice signal VOC and does not generate the first result signal R1, i.e., the first result signal R1 with the low level.

Figure 3B:
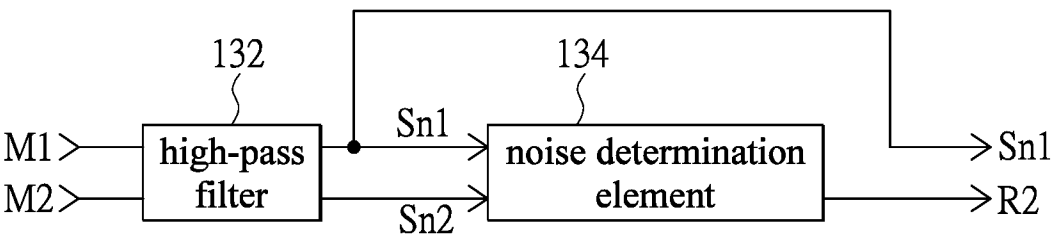
FIG. 3B shows a diagram of a noise detector according to an embodiment of the present disclosure.

Similarly, referring to FIGS. 2 and 3B, the noise detector 130 receives the first signal M1 transmitted from the first microphone MIC1 and the second signal M2 transmitted from the second microphone MIC2. The noise detector 130 takes a burst noise band of the second signal M2 as a second main signal Sn1. When the noise detector 130 determines that the second main signal Sn1 has the burst noise signal, the noise detector 130 generates a second result signal R2.

In the present disclosure, the noise detector 130 includes a high-pass filter 132 and a noise determination element 134. The high-pass filter 132 takes the burst noise band of the second signal M2 as the second main signal Sn1 and takes the burst noise band of the first signal M1 as the second assistant signal Sn2. The burst noise band of the present disclosure is higher than 4 k Hz. Therefore, the second main signal Sn1 is signals above 4 k Hz of the second signal M2 and the second assistant signal Sn2 is signals above 4 k Hz of the first signal M1. Certainly, the burst noise band can be set to be other suitable bands according to actual conditions. The present disclosure is not limited thereto.

The noise determination element 134 electrically connects to the high-pass filter 132 and compares the energy of the second main signal Sn1 with the energy of the second assistant signal Sn2. When the energy of the second main signal Sn1 is higher than the energy of the second assistant signal Sn2 to reach a predefined value, the noise determination element 134 determines that the second main signal Sn1 has the burst noise signal and then generates the second result signal R2. For example, when the energy of the second main signal Sn1 is divided by the energy of the second assistant signal Sn2 and the calculation result is greater than 2, it indicates that the energy of the second main signal Sn1 is higher than the energy of the second assistant signal Sn2 to reach a predefined value. At this time, the noise determination element 134 generates the second result signal R2 with the high level. Conversely, when the energy of the second main signal Sn1 is lower than the energy of the second assistant signal Sn2 to reach a predefined, the noise determination element 134 determines that the second main signal Sn1 does not have the burst noise signal and does not generate the second result signal R2, i.e., the second result signal R2 with the low level.

Figure 4A:
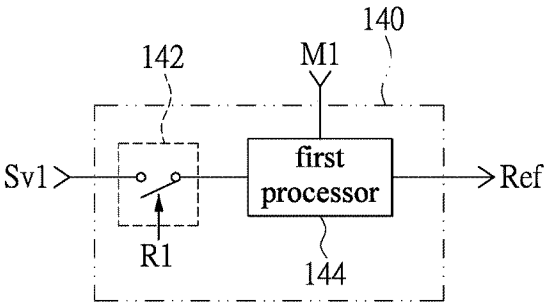
FIG. 4A shows a diagram of a voice filter according to an embodiment of the present disclosure.

Next, referring to FIGS. 2 and 4A, the voice filter 140 is coupled to the voice detector 120 and calculates a remained noise Ref according to the first result signal R1, the first main signal Sv1, and the first signal M1. More specifically, as shown in FIG. 4A, the voice filter 140 includes a first processor 144 and a voice switch 142. The first processor 144 receives the first signal M1. The voice switch 142 electrically connects to the first processor 144 and is turned on or turned off according to the first result signal R1.

When the voice detector 120 generates the first result signal R1 (e.g., the high level in the present disclosure), the voice detector 120 turns on the voice switch 142. At this time, the first processor 144 receives the first main signal Sv1 and takes a difference value between the first signal M1 and the first main signal Sv1 as the remained noise Ref. At this time, the remained noise Ref has the whole burst noise signal and a small portion of the voice signal VOC. Conversely, when the voice detector 120 does not generate the first result signal R1 (e.g., the low level in the present disclosure), the voice detector 120 turns off the voice switch 142. At this time, the first processor 144 does not calculate the remained noise Ref (e.g., the low level in the present disclosure).

Figure 4B:
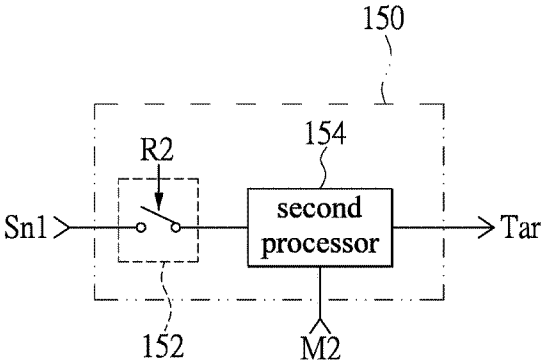
FIG. 4B shows a diagram of a noise filter according to an embodiment of the present disclosure.

Similarly, referring to FIGS. 2 and 4B, the noise filter 150 is coupled to the noise detector 130 and calculates a remained voice Tar according to the second result signal R2, the second main signal Sn1, and the second signal M2. More specifically, as shown in FIG. 4B, the noise filter 150 includes a second processor 154 and a noise switch 152. The second processor 154 receives the second signal M2. The noise switch 152 electrically connects to the second processor 154 and is turned on or turned off according to the second result signal R2.

When the noise detector 130 generates the second result signal R2 (e.g., the high level in the present disclosure), the noise detector 130 turns on the noise switch 152. The second processor 154 receives the second main signal Sn1 and takes a difference value between the second signal M2 and the second main signal Sn1 as the remained voice Tar. At this time, the remained voice Tar has the whole voice signal VOC and a small portion of the burst noise signal. Conversely, when the noise detector 130 does not generate the second result signal R2 (e.g., the low level in the present disclosure), the noise detector 130 turns off the noise switch 152. At this time, the second processor 154 does not calculate the remained voice Tar (e.g., the low level in the present disclosure).

Figure 5:
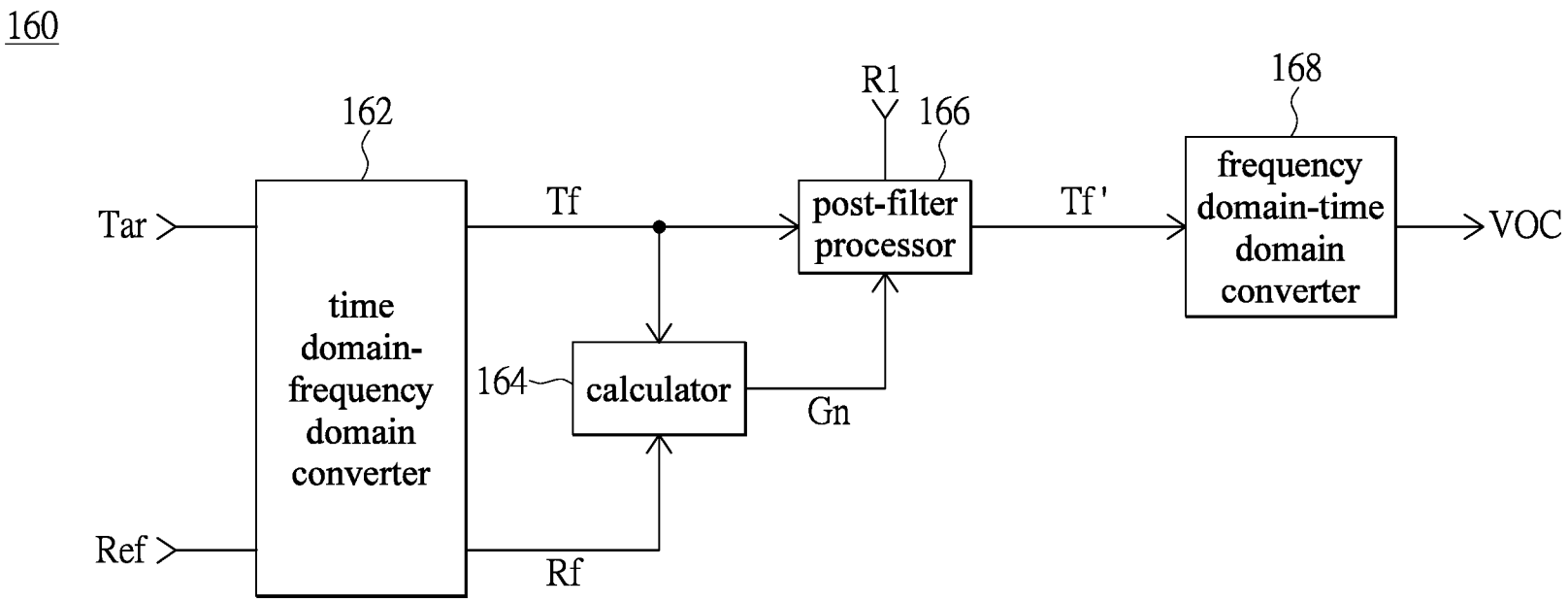
FIG. 5 shows a diagram of a post-filter according to an embodiment of the present disclosure.

Next, referring to FIGS. 2 and 5, the post-filter 160 is coupled to the voice filter 140 and the noise filter 150. The post-filter 160 generates a noise reduction gain according to the remained voice Tar and the remained noise Ref and generates the voice signal VOC according to the noise reduction gain and the remained voice Tar. When the post-filter 160 determines that the first main signal Sv1 has the voice signal VOC, the post-filter 160 maintains or increases the noise reduction gain. When the post-filter 160 determines that the first main signal Sv1 does not have the voice signal VOC, the post-filter 160 decreases the noise reduction gain.

More specifically, as shown in FIG. 5, the post-filter 160 includes a time domain-frequency domain converter 162, a calculator 164, a post-filter processor 166, and a frequency domain-time domain converter 168. The time domain-frequency domain converter 162 converts the remained voice Tar and the remained noise Ref from a time domain into a frequency domain to generate a frequency domain voice Tf and a frequency domain noise Rf respectively. The persons of ordinary skill in this technology field should realize the implementation method of converting the time domain into the frequency domain, so detailed description is omitted.

The calculator 164 electrically connects to the time domain-frequency domain converter 162. The calculator 164 receives the remained voice Tar and the remained noise Ref and calculates a noise reduction gain Gn between the frequency domain voice Tf and the frequency domain noise Rf. In the present disclosure, the noise reduction gain Gn is signal-to-noise ratio (SNR). Therefore, the noise reduction gain Gn is the ratio between the remained voice Tar and the remained noise Ref. The noise reduction gain Gn can be calculated according to actual conditions. The present disclosure is not limited thereto.

The post-filter processor 166 electrically connects to the time domain-frequency domain converter 162, the calculator 164, and the voice detector 120. The post-filter processor 166 adjusts the noise reduction gain Gn according to the first result signal R1 and adjusts the frequency domain voice Tf according to the adjusted noise reduction gain Gn to generate a voice adjustment signal Tf'. More specifically, when the voice detector 120 generates the first result signal R1 (e.g., the high level in the present disclosure), it indicates that the user is speaking. At this time, the post-filter processor 166 determines that the first main signal Sv1 has the voice signal VOC according to the first result signal R1. The post-filter processor 166 maintains or increases the noise reduction gain Gn and correspondingly adjusts the frequency domain voice Tf to generate the voice adjustment signal Tf'. Conversely, when the voice detector 120 does not generate the first result signal R1 (e.g., the low level in the present disclosure), it indicates that the user is not speaking. At this time, the post-filter processor 166 determines that the first main signal Sv1 does not have the voice signal VOC according to the first result signal R1. The post-filter processor 166 decreases the noise reduction gain Gn and correspondingly adjusts the frequency domain voice Tf to generate the voice adjustment signal Tf'.

In other embodiments, the post-filter processor 166 can also adjust the noise reduction gain Gn according to the second result signal R2 and adjusts the frequency domain voice Tf according to the adjusted noise reduction gain Gn to generate the voice adjustment signal Tf'. For example, when the noise detector 130 generates the second result signal R2 (e.g., the high level in the present disclosure), it indicates that the user is interfered with by the burst noise signal. At this time, the post-filter processor 166 decreases the noise reduction gain Gn according to the second result signal R2 and correspondingly adjusts the frequency domain voice Tf to generate the voice adjustment signal Tf'. Conversely, when the noise detector 130 does not generate the second result signal R2 (e.g., the low level in the present disclosure), it indicates that the user is not interfered with by the burst noise signal. At this time, the post-filter processor 166 maintains or increases the noise reduction gain Gn according to the second result signal R2 and correspondingly adjusts the frequency domain voice Tf to generate the voice adjustment signal Tf'.

After generating the voice adjustment signal Tf', the frequency domain-time domain converter 168 connected to the post-filter processor 166 converts the voice adjustment signal Tf' from the frequency domain into the time domain to generate the voice signal VOC. The persons of ordinary skill in this technology field should realize the implementation method of converting the frequency domain into the time domain, so detailed description is omitted.

In summary, the present disclosure provides the voice apparatus and the dual-microphone voice system with noise cancellation. The voice detector 120 and the noise detector 130 simultaneously receive the first signal M1 and the second signal M2 to acquire the first main signal Sv1 with the voice band and the second main signal Sn1 with the burst noise band respectively. The voice filter 140 filters the voice signal to remain the burst noise signal with some voice signals (i.e., the remained noise Ref) according to the first result signal R1, the first main signal Sv1, and the first signal M1. The noise filter 150 filters the burst noise signal to remain the voice signal with some burst noise signals (i.e., the remained voice Tar) according to the second result signal R2, the second main signal Sn1, and the second signal M2. The post-filter 160 generates the noise reduction gain Gn according to the remained voice Tar and the remained noise Ref. Then the post-filter 160 adjusts the remained voice Tar according to the noise reduction gain Gn to generate the voice signal VOC. Accordingly, the voice apparatus and the dual-microphone voice system determine and process the first signal M1 and the second signal M2 to cancel the burst noise signal stably and maintain the clear voice signal simultaneously.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A voice apparatus with noise cancellation, used for cancelling a burst noise signal and remaining a voice signal, and the voice apparatus comprising:

a voice detector configured for receiving a first signal generated from a first microphone and a second signal generated from a second microphone, taking a voice band of the first signal as a first main signal, wherein when the voice detector determines that the first main signal has the voice signal, the voice detector generates a first result signal, the first microphone is close to a voice source, and the second microphone is close to a noise source;

a noise detector configured for receiving the first signal and the second signal and taking a burst noise band of the second signal as a second main signal, wherein when the noise detector determines that the second main signal has the burst noise signal, the noise detector generates a second result signal;

a voice filter coupled to the voice detector and calculating a remained noise according to the first result signal, the first main signal, and the first signal;

a noise filter coupled to the noise detector and calculating a remained voice according to the second result signal, the second main signal, and the second signal; and a post-filter coupled to the voice filter and the noise filter, configured for generating a noise reduction gain according to the remained voice and the remained noise, and configured for generating the voice signal according to the noise reduction gain and the remained voice;

wherein when the post-filter determines that the first main signal has the voice signal, the post-filter maintains or increases the noise reduction gain, and when the post-filter determines that the first main signal does not have the voice signal, the post-filter decreases the noise reduction gain.

2. The voice apparatus with noise cancellation according to claim 1, wherein the first microphone and the second microphone have a predefined distance therebetween.

3. The voice apparatus with noise cancellation according to claim 1, wherein the voice detector comprises:

a band-pass filter configured for taking the voice band of the first signal as the first main signal and taking the voice band of the second signal as a first assistant signal; and a voice determination element electrically connected to the band-pass filter and configured for comparing the energy of the first main signal with the energy of the first assistant signal, wherein when the energy of the first main signal is higher than the energy of the first assistant signal to reach a predefined value, the voice determination element determines that the first main signal has the voice signal and generates the first result signal.

4. The voice apparatus with noise cancellation according to claim 1, wherein the noise detector comprises:

a high-pass filter configured for taking the burst noise band of the second signal as the second main signal and taking the burst noise band of the first signal as a second assistant signal; and a noise determination element electrically connected to the high-pass filter and configured for comparing the energy of the second main signal and the energy of the second assistant signal, wherein when the energy of the second main signal is higher than the energy of the second assistant signal to reach a predefined value, the noise determination element determines that the second main signal has the burst noise signal and generates the second result signal.

5. The voice apparatus with noise cancellation according to claim 1, wherein the voice filter comprises:

a first processor configured for receiving the first signal; and a voice switch electrically connected to the first processor and configured for being turned on or turned off according to the first result signal;

wherein when the voice detector generates the first result signal, the voice detector turns on the voice switch, the first processor receives the first main signal and takes a difference value between the first signal and the first main signal as the remained noise.

6. The voice apparatus with noise cancellation according to claim 1, wherein the noise filter comprises:

a second processor configured for receiving the second signal; and a noise switch electrically connected to the second processor and configured for being turned on or turned off according to the second result signal;

wherein when the noise detector generates the second result signal, the noise detector turns on the noise switch, the second processor receives the second main signal and takes a difference value between the second signal and the second main signal as the remained voice.

7. The voice apparatus with noise cancellation according to claim 1, wherein the post-filter comprises:

a time domain-frequency domain converter configured for converting the remained voice and the remained noise from a time domain into a frequency domain to generate a frequency domain voice and a frequency domain noise respectively;

a calculator electrically connected to the time domain-frequency domain converter and configured for calculating a noise reduction gain between the frequency domain voice and the frequency domain noise;

a post-filter processor electrically connected to the time domain-frequency domain converter, the calculator, and the voice detector, configured for adjusting the noise reduction gain according to the first result signal and the second result signal, and configured for adjusting the frequency domain voice to generate a voice adjustment signal according to the adjusted noise reduction gain; and a frequency domain-time domain converter electrically connected to the post-filter and configured for converting the voice adjustment signal from the frequency domain into the time domain to generate the voice signal.

8. The voice apparatus with noise cancellation according to claim 7, wherein when the post-filter processor determines that the first main signal has the voice signal according to the first result signal or the second main signal does not have the burst noise signal according to the second result signal, the post-filter processor maintains or increases the noise reduction gain, and when the post-filter processor determines that the first main signal does not have the voice signal according to the first result signal or the second main signal has the burst noise signal according to the second result signal, the post-filter processor decreases the noise reduction gain.

9. The voice apparatus with noise cancellation according to claim 1, wherein the burst noise signal is a keyboard sound or a button sound.

10. The voice apparatus with noise cancellation according to claim 1, wherein the voice band of the first signal is a human voice band.

11. A dual-microphone voice system with noise cancellation, used for cancelling a burst noise signal indicating a keyboard sound and a button sound and used for remaining a voice signal indicating a human voice, and the dual-microphone voice system comprising:

a first microphone and a second microphone configured for receiving the voice signal generated from a voice source and the burst noise signal generated from a noise source to respectively generate a first signal and a second signal;

a voice detector coupled to the first microphone and the second microphone, configured for receiving the first signal and the second signal, taking a voice band of the first signal as a first main signal, wherein when the voice detector determines that the first main signal has the voice signal, the voice detector generates a first result signal;

a noise detector coupled to the first microphone and the second microphone, configured for receiving the first signal and the second signal, and taking a burst noise band of the second signal as a second main signal, wherein when the noise detector determines that the second main signal has the burst noise signal, the noise detector generates a second result signal;

a voice filter coupled to the voice detector and calculating a remained noise according to the first result signal, the first main signal, and the first signal;

a noise filter coupled to the noise detector and calculating a remained voice according to the second result signal, the second main signal, and the second signal; and a post-filter coupled to the voice filter and the noise filter, configured for generating a noise reduction gain according to the remained voice and the remained noise, and configured for generating the voice signal according to the noise reduction gain and the remained voice;

wherein when the post-filter determines that the first main signal has the voice signal, the post-filter maintains or increases the noise reduction gain, and when the post-filter determines that the first main signal does not have the voice signal, the post-filter decreases the noise reduction gain.

* * * * *